United States Patent [19]

Hampshire et al.

[11] Patent Number: 4,890,561

[45] Date of Patent: Jan. 2, 1990

[54] EXTENDABLE KEYBOARD SUPPORT ASSEMBLY

[75] Inventors: James F. Hampshire, Stephens City, Va.; Hugh F. Groth, Richfield; John M. Collins, Sagamore Hills, both of Ohio

[73] Assignee: Rubbermaid Commercial Products Inc., Winchester, Va.

[21] Appl. No.: 703,380

[22] Filed: Feb. 20, 1985

[51] Int. Cl.[4] ..... A47B 21/03

[52] U.S. Cl. ..... 108/137; 108/102; 108/143

[58] Field of Search ..... 108/5, 102, 137, 143; 297/341, 344; 248/298; 312/208, 319, 333, 348

[56] References Cited

U.S. PATENT DOCUMENTS

| | | | |
|---|---|---|---|
| 404,396 | 6/1889 | Fuller | 108/5 |
| 1,228,067 | 5/1917 | Severance | 312/333 |
| 1,888,736 | 11/1932 | Park | 108/137 |
| 1,995,640 | 3/1935 | Hess et al. | 312/333 X |
| 2,011,251 | 8/1935 | Michelson | 108/143 |
| 2,235,239 | 3/1941 | Saunders | 297/344 X |
| 2,313,023 | 3/1943 | Ruegger | 297/344 X |
| 2,646,839 | 7/1953 | Hillman | 297/344 X |
| 2,678,681 | 5/1954 | Haltenberger | 297/344 |
| 2,713,530 | 7/1958 | Chisolm . | |
| 3,700,301 | 10/1972 | Boeck | 312/333 |
| 3,919,949 | 11/1975 | Rendleman . | |
| 4,316,082 | 4/1983 | Fritz . | |
| 4,379,429 | 4/1983 | Gubbe et al. . | |
| 4,440,096 | 4/1984 | Rice et al. | 108/5 X |

FOREIGN PATENT DOCUMENTS

| | | | |
|---|---|---|---|
| 244534 | 1/1966 | Austria | 108/137 |
| 1119690 | 12/1961 | Fed. Rep. of Germany | 297/344 |
| 60328 | 11/1954 | France | 312/348 |
| 320751 | 10/1929 | United Kingdom | 108/137 |

*Primary Examiner*—Peter R. Brown
*Attorney, Agent, or Firm*—Richard B. O'Planick

[57] ABSTRACT

A keyboard support assembly for a computer work stand is disclosed comprising a subplate (74) having a profiled opening (98, 100) along each side, and a keyboard support plate (78) residing on top of the subplate. A pair of pivotal locking devices (138) are attached to the underside of the keyboard support plate to depend into the subplate profiled openings, and to selectively engage against an underside of the subplate as the keyboard support plate is slideably re-positioned thereon. The locking devices (138) include gear teeth 140 which engage with a gear rack segment 102 along the subplate underside.

14 Claims, 4 Drawing Sheets

EXTENDABLE KEYBOARD SUPPORT ASSEMBLY

TECHNICAL FIELD

This invention relates to computer work stands, in general, and specifically to extendable keyboard support assemblies for such stands.

BACKGROUND OF THE INVENTION

Keyboard support assemblies for computer work stands are known in the art, such as those depicted in U.S. Pat. Nos. 4,316,082 and 4,379,429. Such assemblies are adjustable in certain limited respects, and typically provided a keyboard support surface having side extending rollers which travel in slots formed in the work stand. By manually changing the slot path in which the rollers travel, the support surfaces can be brought toward the user and into a work orientation.

While the presently available keyboard assemblies work well, and have achieved acceptance in the industry, certain shortcomings prevent them from meeting all of the market's requirements. One shortcoming is that the degree, or fineness, of horizontal adjustment provided by such assemblies is limited. Further, adjustment can be achieved only through relatively awkward manual manipulation of the keyboard bearing surface.

The keyboard support surfaces of said patents are generally supported in cantilever fashion which require that the surface be heavy:-enough- to bear the intended load weight. Resultingly, the operator must lift substantially the entire weight of the keyboard surface and the load carried thereupon in order to make a horizontal adjustment. This further reduces convenience and commercial appeal of the product.

Finally, available keyboard support assemblies lack a positive locking feature which can prevent inadvertent surface movement from jarring or the like. Lack of an automatic and positive lock can create instability, which likewise is commercially undesirable.

DISCLOSURE OF INVENTION

The present invention provides a keyboard support assembly for a computer work stand which is structurally stable, which can be conveniently and finely adjusted by the operator, and which provides an automatic and positive lock independent of keyboard support assembly motion. The keyboard support assembly comprises a sub-plate having a profiled opening extending partially along each side from a rearward end thereof, and a keyboard support plate slideably mounted over the sub-plate and curving the profiled openings. The assembly further comprises a pair of locking devices for attachment to the keyboard support plate, which depend into the sub-plate profiled openings. Each locking device has an upward gear rack segment at a forward end for selectively meshing with an underside gear rack segment of the sub-plate proximate the profiled opening. The keyboard support surface is thereby substantially supported by the sub-plate and can be adjusted horizontally in relatively fine increments. The assembly further comprises means for biasing each locking device into engagement with its sub-plate rack segment, which can be released digitally as the keyboard support surface is contemporaneously extended and retracted.

It is therefore an objective of the present invention to provide a keyboard support assembly providing fineness of adjustment, and positive locking between the keyboard support surface and the supporting structure.

It is a further objective of the present invention to provide a keyboard support assembly adapted to facilitate easy and smooth extension and retraction of the keyboard support surface.

Still further, it is an objective of the present invention to provide a keyboard support assembly comprising a fully supported keyboard receiving surface.

Further, it is an objective of the present invention to provide a keyboard support assembly having a minimal profiled dimension, which provides maximum leg clearance.

It is a further objective of the present invention to provide a keyboard support assembly which achieves automatic locking of the keyboard support surface.

Another objective of the present invention is to provide a keyboard support assembly providing a lock which releases conveniently and contemporaneously with the movement of the keyboard support surface.

It is a further objective of the present invention to provide a keyboard support assembly which is economically and readily produced and assembled.

These and other objectives, which will be apparent to those skilled in the art, are achieved by a preferred embodiment which is described in detail below, and which is illustrated accompanied drawings.

PREFERRED EMBODIMENTS FOR CARRYING OUT THE INVENTION

Figure 1:
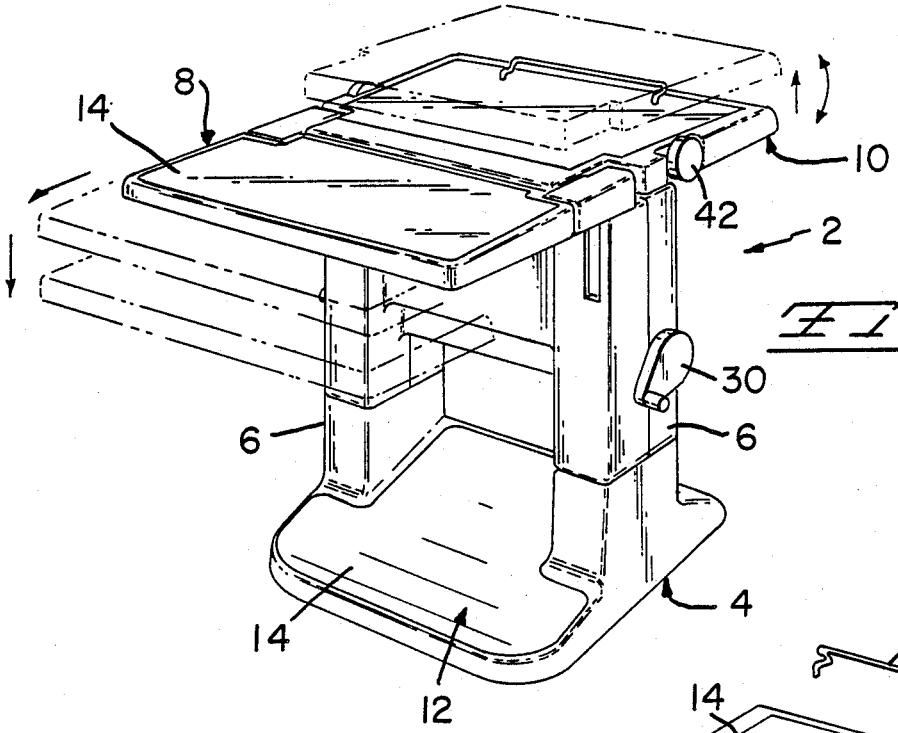
FIG. 1 is view of a computer work stand of the type comprising the subject invention.

Referring to FIG. 1, a computer work stand 2 is shown generally as comprising a rectangular pedestal base 4; two spaced apart vertical support columns 6 extending upward from opposite sides of the base 4; a keyboard support assembly 8 positioned to the front of the work stand 2; a video terminal support assembly 10 positioned rearwardly of the stand; and a rearwardly inclined footrest 12 spanning the base 4 between the columns 6. A rubber anti-skid matting 14 is affixed to the external surfaces of the keyboard support assembly 8, the video terminal support assembly 10, and the footrest 12.

It will be appreciated that the keyboard support assembly is intended to receive the keyboard console of a computer or word processing system, and is adjustable vertically and horizontally to accomodate the operator. The video terminal support assembly 10, which receives a monitor or cathode ray tube thereupon, can be adjusted both vertically and rotationally about a horizontal axis, to align with the operators' line of vision.

Figure 2:
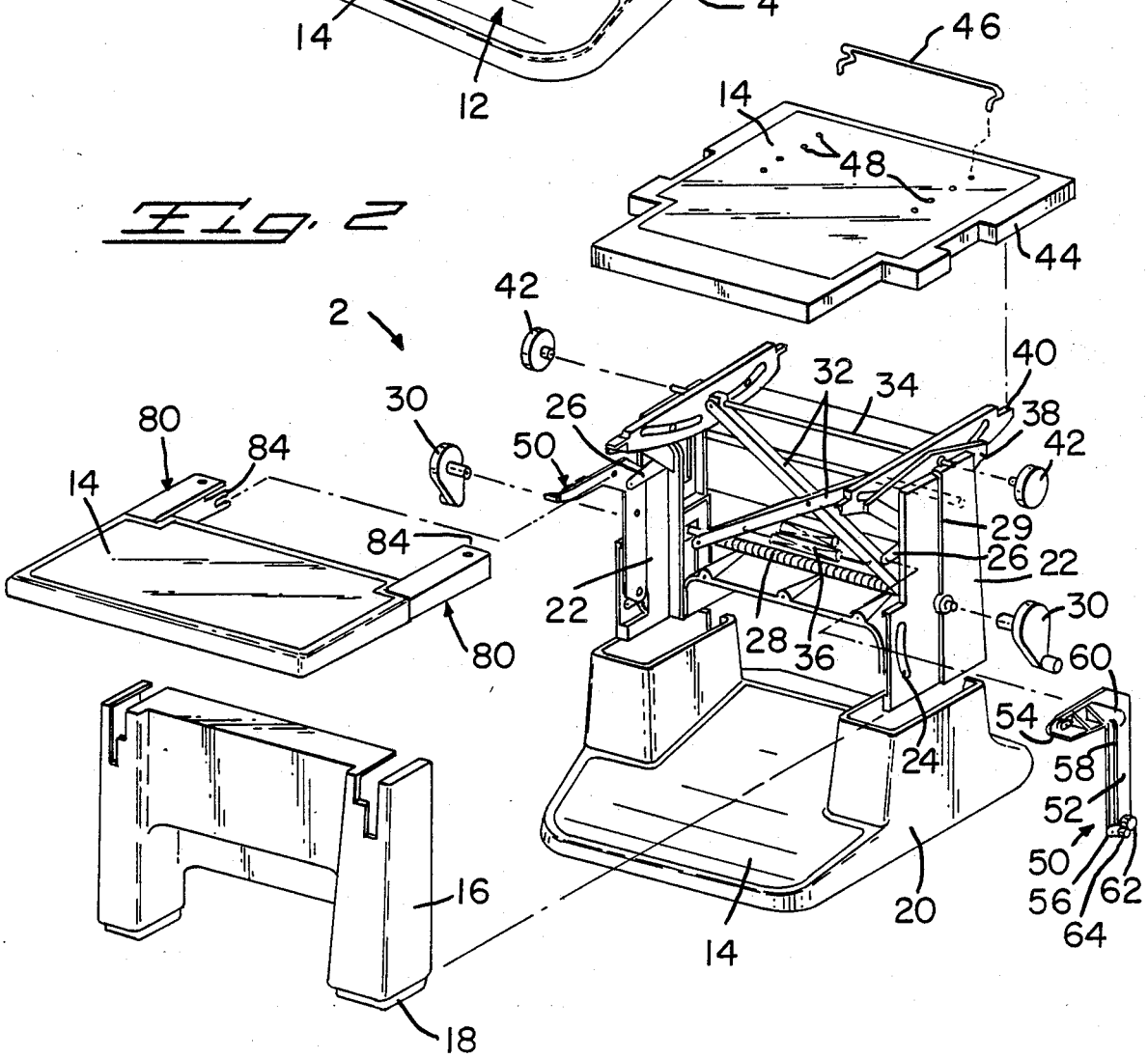
FIG. 2 is an exploded perspective view of the computer work stand depicted in FIG. 1, illustrating the component parts thereof.

FIG. 2 illustrates the work stand in an exploded perspective view. A preformed, molded frontal cover 16, constructed of conventional plastics material, has incut bottom legs 18 of reduced sectional dimension, which are insertable into the upward collar of a premolded pedestal shell 20. A spaced-apart pair of vertical structural panels 22, of structural plastic, extend upward from the pedestal shell 20. Each panel 22 has a vertically oriented arcuate gear rack segment 24 therethrough, located near the base of each respective panel. A horizontal support arm 26 extends from each panel 22 in cantilever fashion, toward the front end of the work stand 2 for a purpose described below.

A horizontal lead screw 28 extends between the structural panels 22 of the work station 2, with opposite ends of the screw projecting through the panels 22, each of which ends being journaled to a rotary actuator crank 30. The lead screw 28 is further journeled to bottom ends of the scissor-linkages 32. Upper ends of linkages 32 are affixed to a horizontal throughshaft 34 located at the top of the work stand 2. An extension spring 36 is connected in tension between lower portions of linkages 32, as mechanical assists to upward extension.

A bearing plate 38 and a cam plate 40 adjacent thereto are mounted to each side of the work stand 2, receiving opposite ends of the shaft 34 therethrough. Actuator knobs 42 are attached to ends of shaft 34, and function to rotate cam plates 40. A video terminal table 44 is provided for location on cam plates 40. The table 44 is thereby rotatably adjustable to align with the line of vision of different operators. Bracket 46 is provided, inserted through aperture 48, to retain a video terminal upon the table 44.

With continued reference to FIG. 2, a keyboard lift assembly 50 is provided on each side of the work station 2, and comprises a vertical L-shaped plate 5 to which a pivoting actuator paddle 54 is attached. A smaller L-shaped pivot plate 56 is pivotally attached to a lower end of plate 52, linked to actuator paddle 54 by a tie-rod 58. A lock-spring 60 biases the paddle 54 downward and the pivot plate 52 in a counter-clockwise direction. A guide gear 62 and a lock gear 64 are mounted to the pivot plate 56 in adjacent relationship. A keyboard lift arm assembly 50 of the type above described attaches to each horizontal arm 26 of the work stand, and operates to selectively bear the gears 62, 64 against the arcuate rack segments 24 of the stand. By pivoting both paddles 54 upward, the horizontal support arms 26 are released and can be raised or lowered to adjust the height of the keyboard support assembly 8 which is attached thereto.

Figure 3:
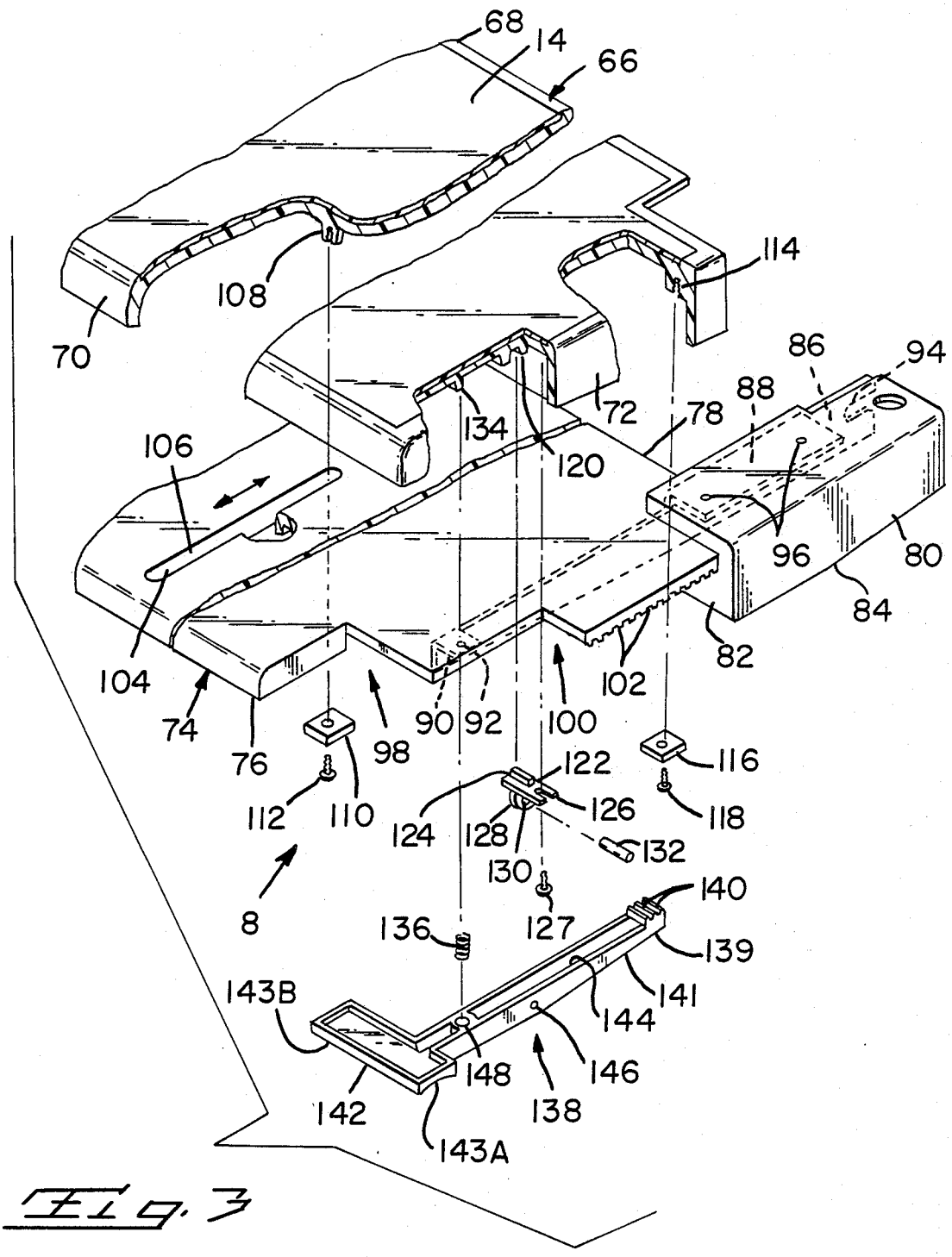
FIG. 3 is a partial exploded perspective view of the right side of the keyboard support assembly, with portions of the keyboard support plate sectioned away for the purpose of illustration.

Reference will next to be made to FIG. 3, showing details of the right-hand portion of the keyboard support assembly 8. It will be appreciated from the foregoing description of FIG. 2, that the left-hand side of the keyboard support assembly 8 is identically structured to the right-hand side. Therefore, the following specification of the right-hand portion of the keyboard support assembly 8, is likewise applicable to identical mirror image and equivalent components comprising the left-hand side of the keyboard support assembly 8 as shown in FIGS. 1 and 2.

FIG. 3 shows the keyboard support assembly 8 as comprising a keyboard support plate 66, having a top surface 68 extending between a rearward downturned end wall 70 and outward facing downturned sidewalls 72 (one of which being shown in FIG. 3). The keyboard support plate 66 is slidably mounted over a generally rectangular sub-plate 74, having a rearward end 76 and a forward end 78. The keyboard support plate 66 mounts over the sub-plate 74 so as to retract forward toward end 78, and extend backward toward rearward end 76. In the retracted condition, sidewalls 72 and end wall 70 of plate 66 enclose corresponding side and end walls of plate 74.

An elongate mounting bracket 80 is attached to the forward corners of the sub-plate 74, and projects forward therefrom. The mounting brackets 80 have an enclosed rearward end wall 82 and an open forward end 84. An elongate support bar 86 is oriented to extend from the forward end 84 of the bracket 80, backward along the underside of sub-plate 74. The support bar 86 is configured to provide an upper overturned plate portion 88 at its forward end for supporting the top surface of bracket 80, and an upper overturn flange portion 90 at a rearward end for supporting the underside of support plate 74. Flange portion 90 has a mounting screw 92 extending therethrough and into sub-plate 74. The forward end of support bar 86 has a U-shaped slot 94 formed therein, opening toward forward end 84 of the bracket 80. A pair of assembly screws 96 are provided through the overturned plate portion 88, and extend into sub-plate 74.

The sub-plate 74 is further configured having a profiled opening extending partially along each side, from rearward end 76. Each opening consists of an incut corner opening portion 98, and an incut side opening 100. The side opening portion 100 is situated contiguous to the corner opening 98, and extends forward therefrom. The openings 98, 100 thereby form a single profiled opening along each side of the sub-plate 74 from the rearward corner toward the forward end thereof. Beginning at the forward terminal end of each opening 100, the sub-plate 74 is adapted having a downward directed geartooth rack segment 102 along each side. As shown, each rack segment extends along an underside surface of the sub-plate 74 forward to the rearward wall 82 of the bracket 80 of each side.

Figure 6:
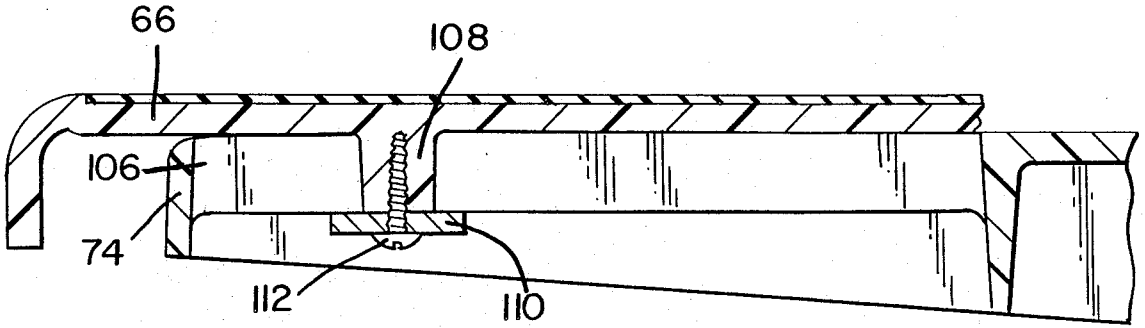
FIG. 6 is a side elevation view in longitudinal section of the keyboard support assembly, showing the operation of the center guide and stop of the assembly.

At the center of the sub-plate 74 is an elongate center guide slot 104 which extends longitudinally from a rearward terminal end 106 forward. The slot 104 is dimensioned to receive a downward center guide boss 108 depending from an underside surface of keyboard support plate 66. A washer 110 and retaining screw 112 are secured to boss 108, as best seen from FIG. 6. Upon abutment of washer 110 against terminal end 106 of the center guide slot 104, further extension of the keyboard support plate 66 relative to the sub-plate 74 is prohibited.

An end guide boss 114 depends downward from each underside corner of the keyboard support plate 66, and moves along a side of the sub-plate 74. Each end guide boss 114 receives an end guide plate 116 and retention screw 118 which function to prevent lateral movement and vertical separation of the plate 66 relative to the sub-plate 74. Movement of plate 66 is thereby restricted to reciprocal forward and backward motion as limited by the travel of center guide boss 108 in slot 104.

In addition, each side the keyboard support plate 66 includes a downward projecting slotted boss 120, for receiving an upward directed flange 124 of a horizontal pivot plate 122. An outward end of plate 122 includes a slot 126 for attachment to the underside of the keyboard support plate 66 by a screw 127. A vertical flange 128 depends perpendicularly from horizontal plate 122 and includes a horizontal apperture 130 dimensioned to receive a cylindrical pivot pin 132 therethrough.

A bias spring boss 134 depends from the underside of the keyboard support plate 66 at a location between the slotted pivot boss 120 and the rearward downturned end wall 70. Boss 134 is dimensioned to receive a helical bias spring 136 therearound for a purpose explained below.

With continued reference to FIG. 3, an actuating lever 138 is shown comprising a forward end 139 incorporating an upward directed gear rack segment 140, a rearward trigger paddle 142, and an intermediate elongate portion 141 defining a longitudinal channel 144. A transverse apperture 146 extends through side walls defining channel 144. A boss receiving socket 148 is located in the lever 128 toward the paddle end 142. Paddle 142 is generally rectangular in plan view as defined by intersecting side and rear surfaces 143*a*, 143*b*, respectively.

Figure 4:
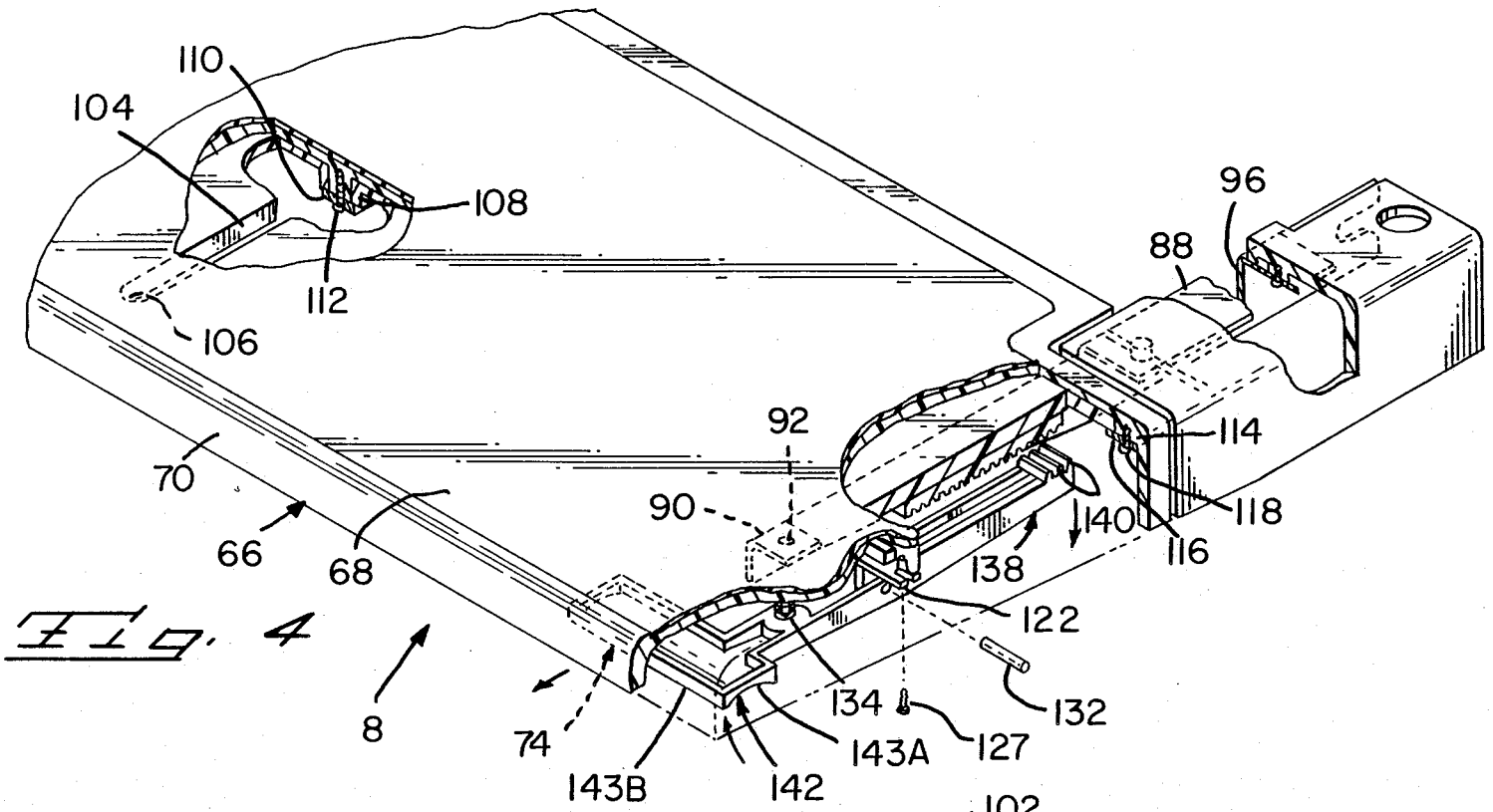
FIG. 4 is a partially assembled perspective view of the keyboard-support assembly portion shown in FIG. 3, with portions of the keyboard support plate sectioned away for the purpose of illustration. The keyboard support plate is illustrated in the fully retracted condition.

FIG. 4 illustrates the subject keyboard support assembly 8 in partial assembled condition with keyboard support surface 66 in the retracted condition relative to sub-plate 74. Referring to FIG. 3 and 4, the keyboard support surface 66 is mounted over the sub-plate 74 such that end and side walls 70, 72 of plate 66 are contiguous with corresponding end and side walls of the sub-plate 74, and top surface 68 of plate 66 covers the profiled openings of the sub-plate 98, 100. The lever 138 attaches to the underside of the keyboard support plate 66, and depends into the opening 98, 100 of the sub-plate 74. Paddle 142 resides in opening portion 98, intermediary portion 141 of the lever resides in opening portion 100, and the forward end 139 of the lever extends forward to position gear rack 140 below corresponding gear rack segment 102 of the sub-plate 74.

The flange 124 of the horizontal pivot plate 122 is seated within slotted boss 120 of the keyboard support plate 66, and secured thereto by screw 127. The depending flange 128 extends into channel 144 of the lever 138, and appertures 130, 146 accept pivot pin 132 therethrough. Helical spring 136 is mounted over boss 134 which seats in lever socket 148.

Resultingly, lever 138 is pivotally hinged to the underside surface of the keyboard support plate 66, and is reciprocally moveable in a vertical direction about pivot pin 132. The helical spring 136, placed in compression by the above assembly, biases the paddle end 142 downward, and geartooth rack segment 139 upward into meshing engagement with gearteeth 102 of the sub-plate 74. The spring bias can be manually overridden by upward pressure on paddle 142, yet operates to re-establish a positive lock between gear racks 102, 139 as soon as such pressure is removed.

FIG. 4 illustrates the keyboard support plate 66 in a fully retracted state. Center guide boss 108, and center guide plate 110, reside within slot 104, and are moveable backward therelong as the keyboard support plate is extended to the limit of travel represented by FIG. 5.

Figure 5:
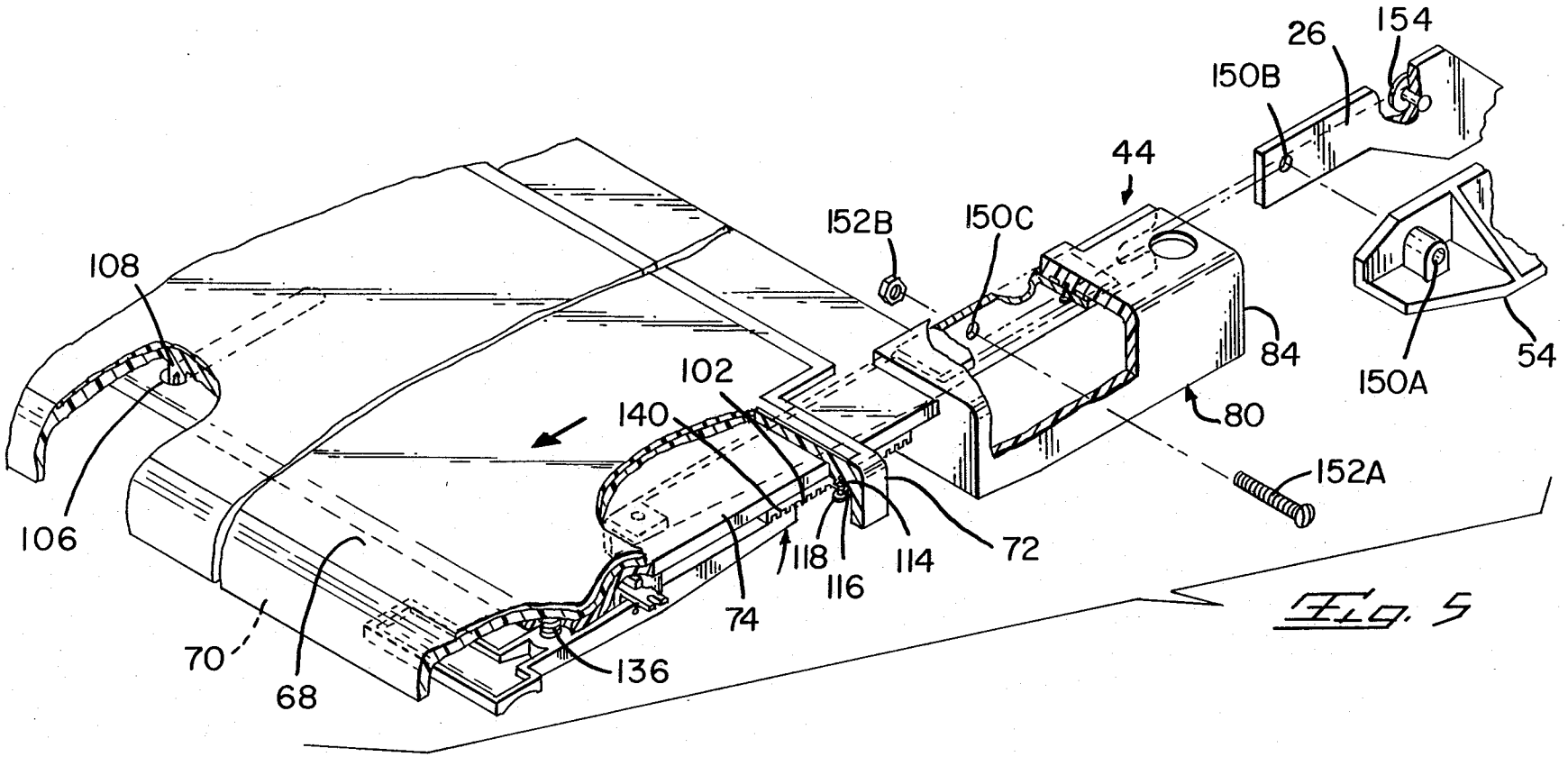
FIG. 5 is a partially assembled perspective view of the subject keyboard support assembly shown in subsequence to FIG. 4, and portions of the work stand to which attachment is made. Portions of the keyboard support assembly are sectioned away for the purpose of illustration.

Viewing FIGS. 1 and 5 in combination, the assembled keyboard support assembly 8 can be attached to the work stand 2 by aligning brackets 80 with corresponding arms 26 of the stand. Open ends 84 of brackets 80 receive the horizontal arms 26, and the actuator paddles 54 therein, with each component providing co-aligning assembly appertures 150*a, b,* and *c*. Attachment is secured by a screw and nut 152 a, b. The horizontal arms 26 each have a fastener 154 which receives the slot 94 of the mounting brackets 80 therearound.

Referring to FIGS. 4 and 5, operation of the subject keyboard support assembly 8 proceeds as follows. It will be appreciated that paddles 142 (the right one of which being shown) are located such that surfaces 138*a* and 138*b* of each paddle are proximate to side and rearward walls 72, 70 of the keyboard support plate 66, and are enclosed thereby. Specifically, the paddle surfaces 143*a, b* are distanced from walls 72, 70 such that an operator, by placing his hands palm downward on rearward corners of surface 68, can digitally reach downward around either, or alternatively both, wall 70 and wall 72, and reach beneath paddles 142. Thereafter, upward pressure on paddles 142 can be exerted to pivot lever 138 clockwise and disengage the gear racks 140 from corresponding meshing gear racks 142 of the sub-plate 74. Recessed lever paddles prevent accidental release of the lock mechanism.

From the foregoing, it can be appreciated that as the operator grasps corners of the support plate 66, and exerts upward pressure on the lever paddles 142 beneath such corners, the operator is simultaneously supporting plate 66 for movement. This action serves to release the lock mechanism via levers 138 and also supports the keyboard support plate 66 for easy extension or retraction. By combining the operators' lock release and slide movements, wasted motion is eliminated.

While the preferred embodiment of the subject invention contemplates locking levers 138 on both sides of keyboard support assembly 8 only, one locking mechanism 138 can be used if so-desired. It should further be recognized that, in the preferred embodiment, the locks on both sides of keyboard support assembly 8 must be released before movement can be effected. Consequently, an operator must manually grasp and support both corners of the keyboard support plate 66 in order to simultaneously release the locking levers 138. This serves to require the operator to properly support the keyboard support plate 66 before attempting a position change, and also serves to prevent accidental release. Moreover, two-lever release precludes the chance of pinched fingers during extension.

Figure 7:
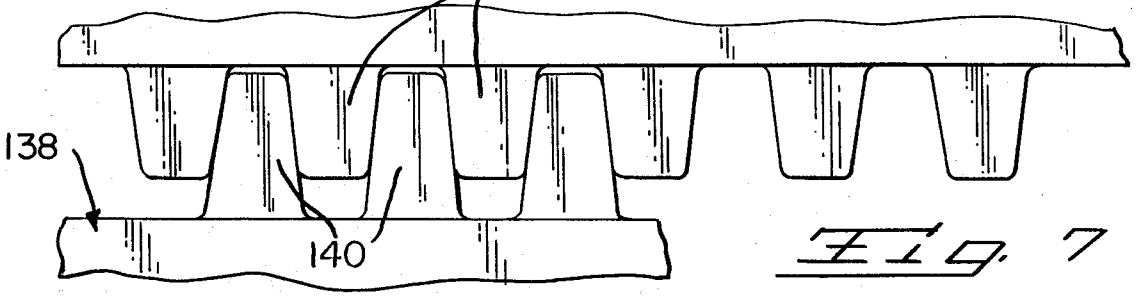
FIG. 7 is a side elevation view of the intermeshing geartooth rack segments of one of the locking levers and the sub-plate comprising the subject keyboard support assembly.

Release of the paddles 142 of levers 138 causes the forward portions of the levers 138 to pivot upward under influence of the bias springs 136. This automatically brings gear teeth segments 102, 140 into meshing engagement and prevents further relative movement between plates 66 and 74. FIG. 7 illustrates the profile of meshing gear rack segments 102, 140. It should be noted that the fineness of adjustment between plates 66 and 74 is dependent upon the gear rack spacing. The greater number of gear teeth per inch, the finer the adjustment possible. Also, while one gear tooth on the levers 138 would suffice for the purpose of the present invention, multiple gear teeth 140 are recommended for a stronger lock. It will be appreciated from FIG. 7 that each gear tooth is of a truncated pyramid profile. The shallow angled sides of each gear tooth, preferably of seven (7°) degrees to the vertical, facilitates engagement between segments 102, 140 after a position change, yet provides a shallow pressure angle to maintain the lock between rack segments.

From FIGS. 3 and 4, it will be recognized that the resultingly assembled keyboard assembly 8 is of minimum profiled height. Plate 66 fits over the sub-plate 74, which is enclosed by downturned plate sides 70, 72. Moreover, depending levers 136 operate substantially within the profiled openings 98, 100 of the sub-plate 74, and between the confines of sides 70, 72. The thickness of sub-plate 74 is therefore used to accommodate part of the profiled dimension of the levers 138, to further reduce the overall profiled size of the assembly. Channel 144 of levers 138 receives depending pivot flanges 128 of the keyboard support plate therein, which serves to raise the pivot point (represented by pin 132) of the levers 138, thereby further minimizing the profiled dimension of the assembly.

While the above sets forth the preferred embodiment of the present invention, the subject disclosure is not to be so limited. Other embodiments which utilize the teachings herein set forth are intended to be within the scope and spirit of the subject invention.

We claim:

1. In an extendable keyboard support assembly for a computer work stand, of the type comprising a sub-plate, a keyboard support plate mounted over the sub-plate so as to be reciprocably moveable forward and backward in relation thereto, and a locking device for selectively inhibiting relative movement between the sub-plate and the keyboard support plate; the improvement comprising:

the sub-plate having a profiled opening covered by the keyboard support plate, and said locking device being attached to the keyboard support plate to depend into said sub-plate profiled opening, and reciprocably move with said keyboard support plate, and said locking device selectively engaging against an underside surface of said sub-plate.

2. An assembly according to claim 1, further comprising means for biasing said locking device against said underside surface of said sub-plate.

3. An assembly according to claim 1, said sub-plate profiled opening extending partially along one side of the sub-plate from a rearward end thereof.

4. An assembly according to claim 1, said sub-plate underside surface extending forwardly along a side from proximate said profiled opening.

5. An assembly according to claim 4, said underside surface comprising a linear rack of downward directed gear teeth.

6. An assembly according to claim 5, said locking device comprising a lever member having a forward portion for engagement against said underside surface of said sub-plate.

7. An assembly according to claim 6, said forward lever member portion providing at least one upwardly directly meshing gear tooth.

8. An assembly according to claim 7, said gear tooth of said forward lever member portion and said gear teeth of said sub-plate underside surface each being of a truncated pyramidal profile.

9. An assembly according to claim 6, said lever member having an intermediate portion providing a longitudinal channel for receiving a downward projecting extension of said keyboard support plate, and including a transverse pivot pin for securing said intermediate portion to said keyboard support plate extension.

10. An assembly according to claim 6, said lever member having a rearward actuator end comprising intersecting outward and rearward facing sides recessed within digital proximity of correspondingly intersecting outward and rearward facing sides of said keyboard support plate.

11. An extendable keyboard support assembly for a computer work stand, comprising:

a sub-plate having a profiled opening extending partially along one side from a rearward end thereof, and a downward directed profiled underside surface extending forwardly along said side from proximate said profiled opening;

a keyboard support plate slideably mounted over said sub-plate and covering said profiled opening, said keyboard support plate being moveable reciprocally forward and backward in relation to said sub-plate;

a lever member depending into said sub-plate profiled opening and comprising: an intermediate portion pivotly attached to said keyboard support plate; a forward end portion for extending beneath and engaging said sub-plate underside surface; and a rearward actuator end portion pivotal upward to disengage said forward end portion from said sub-plate underside surface.

12. An assembly as set forth in claim 11, wherein said sub-plate underside surface comprises a linear rack of downward directed gear teeth, and said lever member forward end portion comprising at least one upward directed meshing gear tooth.

13. An assembly as set forth in claim 12, said gear tooth of said forward lever member portion and said gear teeth of said sub-plate underside surface each having a truncated pyramidal profile.

14. An assembly as set forth in claim 11, wherein said rearward actuator end portion of said lever member comprises a horizontal plate having intersecting outward and rearward facing sides recessed and within digital proximity of correspondingly intersecting outward and rearward facing sides of said keyboard support plate.

* * * * *